US006027439A

United States Patent [19]

Busse et al.

[11] Patent Number: 6,027,439

[45] Date of Patent: Feb. 22, 2000

[54] TWO-PIECE PAPERBOARD LIDS HAVING SPIRAL-WOUND SIDE WALL AND NON-CIRCULAR GEOMETRIES, AND METHODS OF MAKING THE SAME

[75] Inventors: Charles E. Busse, Phoenix; Edward M. Earnest, Owings Mills; David W. Norwood, Joppatowne, all of Md.

[73] Assignee: Sweetheart Cup Company, Inc., Owings Mills, Md.

[21] Appl. No.: 09/027,245

[22] Filed: Feb. 23, 1998

[51] Int. Cl.[7] ..... B31C 11/02; B31C 13/00

[52] U.S. Cl. ..... 493/288; 493/104; 493/158; 493/293; 493/295; 493/299; 493/308

[58] Field of Search ..... 493/153, 158, 493/102, 104, 75, 76, 84, 109, 338, 339, 447, 455, 968, 288, 293, 295, 299, 308

[56] References Cited

U.S. PATENT DOCUMENTS

| | | | |
|---|---|---|---|
| 1,760,029 | 5/1930 | Wright et al. . | |
| 2,074,899 | 3/1937 | Gazette . | |
| 2,120,904 | 6/1938 | Moore . | |
| 2,138,401 | 11/1938 | Gazette . | |
| 2,464,278 | 3/1949 | Wilson . | |
| 2,578,731 | 12/1951 | Nordquist et al. | 493/102 |
| 2,709,400 | 5/1955 | Bugg . | |
| 2,756,003 | 7/1956 | Stahl | 493/299 |
| 3,256,783 | 6/1966 | Richter | 493/295 |
| 3,272,094 | 9/1966 | Carpenter, Jr. . | |
| 3,324,534 | 6/1967 | Spurk | 493/295 |
| 3,610,115 | 10/1971 | Rose et al. | 493/295 |
| 3,619,863 | 11/1971 | Ciabani . | |
| 3,863,552 | 2/1975 | Jorba Gabarró . | |
| 3,910,171 | 10/1975 | Reinhardt et al. . | |
| 4,120,323 | 10/1978 | Saul . | |
| 4,123,312 | 10/1978 | Schmid et al. | 493/308 |
| 4,255,223 | 3/1981 | Saul . | |
| 4,263,076 | 4/1981 | Saul | 493/153 |
| 4,308,023 | 12/1981 | Bidegain | 493/295 |
| 4,349,345 | 9/1982 | Bodendoerfer . | |
| 4,526,562 | 7/1985 | Knudsen et al. | 493/76 |
| 4,571,233 | 2/1986 | Konzal | 493/158 |
| 5,573,638 | 11/1996 | Lennon et al. . | |
| 5,584,789 | 12/1996 | Robertson . | |

*Primary Examiner*—Stephen F. Gerrity
*Attorney, Agent, or Firm*—Nixon & Vanderhye P.C.

[57] ABSTRACT

Spirally-wound circular side walls may be re-formed into non-circular geometries which are then mechanically joined to conformably shaped non-circular closure disks and thereby produce non-circular two-piece paperboard container lids.

9 Claims, 3 Drawing Sheets

| FIG. 2A |
| --- |
| FIG. 2B |

TWO-PIECE PAPERBOARD LIDS HAVING SPIRAL-WOUND SIDE WALL AND NON-CIRCULAR GEOMETRIES, AND METHODS OF MAKING THE SAME

FIELD OF THE INVENTION

The present invention relates generally to paperboard container lids. More specifically, the present invention relates to paperboard container lids having a side wall which is mechanically joined (e.g., via crimping, curling or the like) to a substantially planer closure disk.

BACKGROUND AND SUMMARY OF THE INVENTION

Paperboard container lids having circular geometries which include spirally wound side walls or skirts are well known, as evidenced, for example, by U.S. Pat. No. 1,760,029 to Wright et al. Such circular paperboard lids are well suited to being produced using conventional paperboard tube winding machines. Specifically, in order to produce circular lids having spiral-wound side walls, conventional paperboard tube winding machines may be used to produce a cylinder comprised of spirally wound paperboard sheets. The cylinder is thereafter cross-sectioned to form a plurality of individual circular rings which are mated with respective circular closure disks by crimping the edges of the rings and disks together in a known manner.

Recently, foodstuff containers having non-circular geometries have been provided and have achieved widespread appeal in the marketplace. These containers have been provided with conformably shaped non-circular lids which are formed of a single ply skirt whose ends are adhered to one another in overlapping relationship thereby forming a generally vertical seam. The thus formed non-circular skirt may then be mechanically joined to a conformably shaped non-round closure disk in accordance with conventional paperboard forming techniques.

According to the present invention, conventional spirally-wound circular side walls may be re-formed into non-circular geometries so as to then be mechanically joined to conformably shaped non-circular closure disks. Therefore, conventional paperboard tube winding machines may be employed as in the past to provide individual ring sections that may be re-formed into non-circular geometries and thereafter mated with conformably shaped planar closure disks. In such a manner, conventional paperboard tube winding machines may now be employed in processes to form both non-circular and circular container lids, thereby increasing the efficiencies of such conventional machines.

Further aspects and advantages of the present invention will become more clear after careful consideration is given to the following detailed description of the preferred exemplary embodiments which follow.

BRIEF DESCRIPTION OF THE ACCOMPANYING DRAWINGS

Reference will hereinafter be made to the accompanying drawings, wherein like reference numerals throughout FIGS. 1 and 2A–2B denote like structural elements, and wherein;

FIG. 1 is a perspective view, partly in section of an exemplary two-piece non-circular container lid in accordance with the present invention; and FIGS. 2, 2A and 2B are schematic sequence drawings depicting one preferred processing sequence to form the non-circular container lids of this invention.

DETAILED DESCRIPTION OF THE INVENTION

Figure 1:
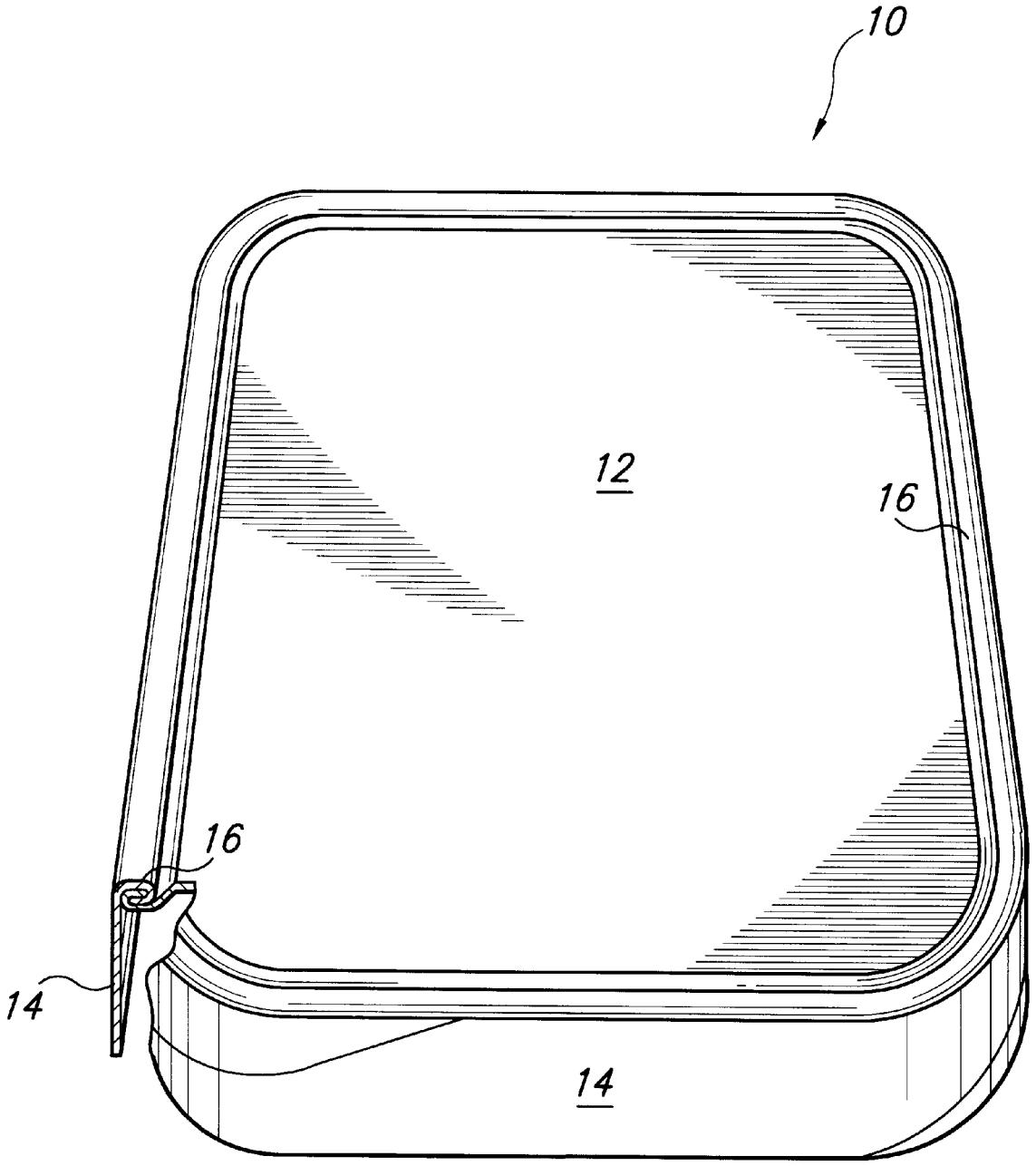

As shown in FIG. 1, the container lid 10 in accordance with the present invention is essentially a two-piece paperboard structure. That is, the container lid 10 includes a non-circular planar closure disc 12 and a depending side wall or skirt 14. The closure disc 12 and skirt 14 are mechanically coupled to one another by conventional techniques well known in the paperboard reforming art. Thus, for example, as shown in FIG. 1, the closure disc 12 and skirt 14 may be mechanically interlocked to one another about respective peripheral edges by folding such edges over and onto one another to create a junction bead 16.

The lid 10 shown in FIG. 1 just happens to be generally rectangular in geometric configuration —that is, having a generally rectangular closure disk 12 and conformably shaped depending skirt 14 with slightly rounded corners. However, other non-circular geometric shapes may also be provided for lid 10 as may be desired, such as lids that are generally square, oval or elliptical in geometric configuration.

Figures 2, 2A:
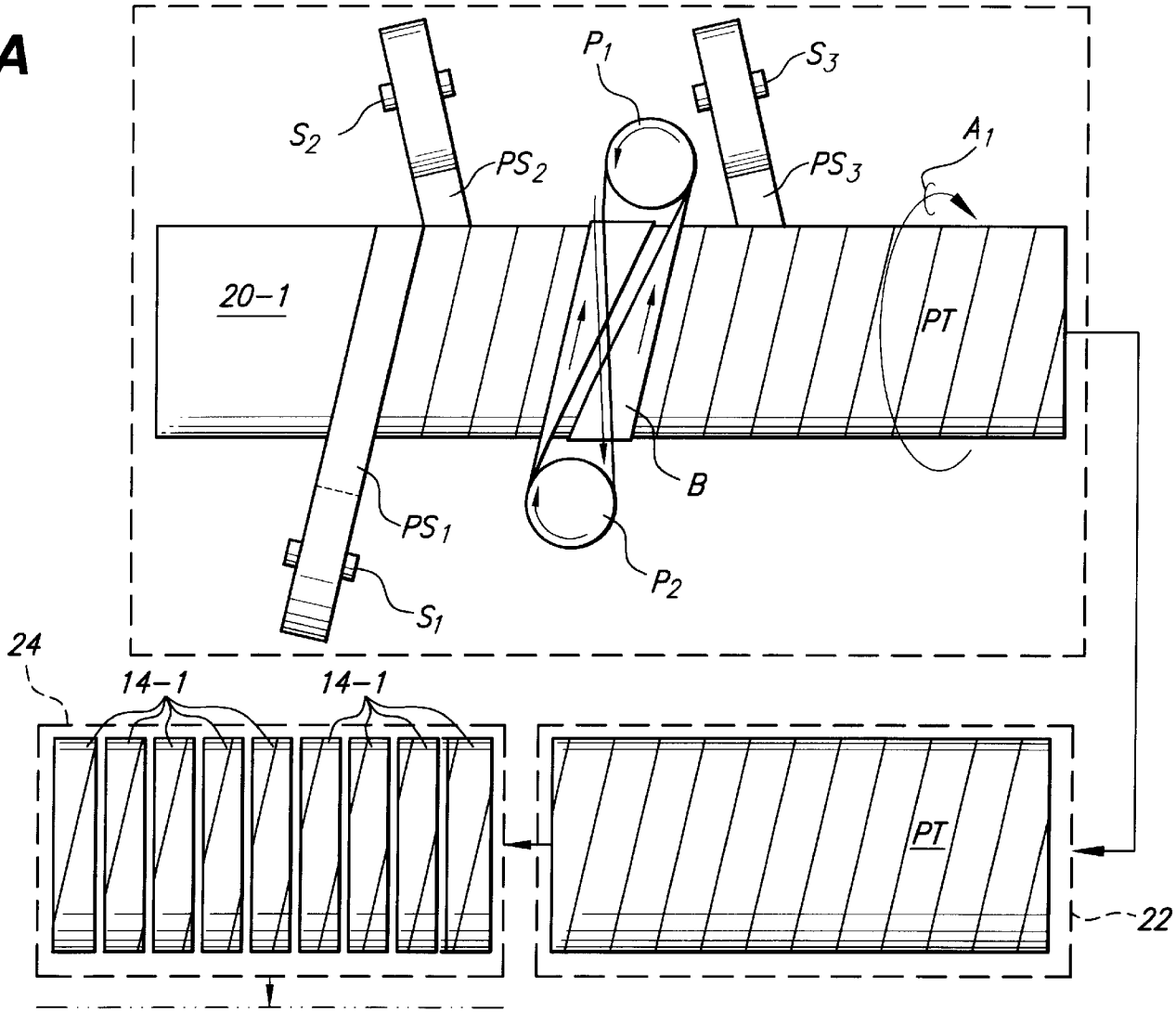
Figure 2B:
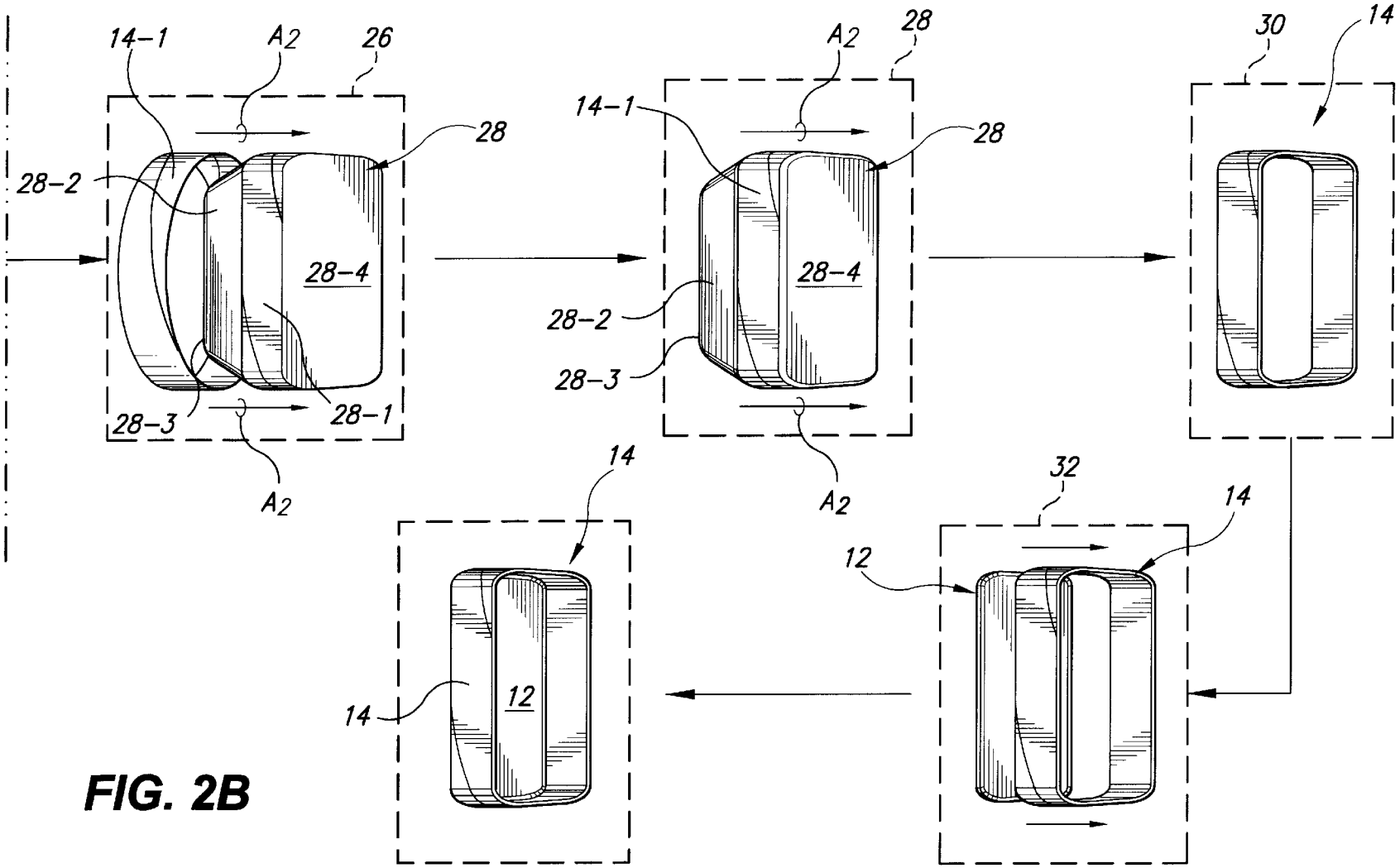

Accompanying FIGS. 2A and 2B show a sequence of a preferred manufacturing process for forming the two-piece, non-circular container lids 10 in accordance with the present invention. In this regard, step 20 generally depicts a conventional paperboard tube winding machine having a stationary forming mandrel 20-1 on which is applied paperboard strips $PS_1$–$PS_3$ as inner, middle and outer plies, respectively, of the paperboard tube PT formed on the mandrel 20-1. An endless winding belt B is directed around a pair of driven pulleys $P_1$ and $P_2$ and than around the exterior of the paperboard tube PT. Frictional engagement between the winding belt B and the paperboard tube PT will thus cause the latter to rotate relative to the forming mandrel 20-1 in the direction shown by arrow $A_1$ in FIG. 2A. A cylindrical paperboard tube PT of predetermined length will therefore be formed on the mandrel 20-1 by spirally winding thereon paperboard strips $PS_1$–$PS_3$ from their respective supply reels $S_1$–$S_3$. A suitable adhesive is applied to the edges of the paperboard strips $PS_1$–$PS_3$ by a suitable applicator (not shown) so that the resulting paperboard tube PT is self-supporting structure when removed from the mandrel 20-1 as depicted in step 22.

In step 24, the paperboard tube PT is sectioned, for example, by a suitable cutting tool (e.g., paperboard saw), into multiple cylindrical bands or skirt preforms 14-1 which ultimately will be reformed into the skirt 14 of the lid 10 in subsequent process steps to be discussed below. Preferably, the lengthwise dimension of the skirt preforms 14-1 (as measured parallel to the central longitudinal axis of its cylindrical surface) is typically less than about 25% of its diameter dimension, and usually between about 10% to about 20% of the diameter dimension.

In step 26, each of the cylindrical skirt preforms 14-1 is brought into coaxial alignment with a reform mold 28. The reform mold 28 has a perimetrical forming surface 28-1 which conforms to the final geometric configuration of the skirt 14, and a transition surface 28-2. In this regard, the transition surface 28-2 and the forming surface 28-1 are positioned in contiguous relationship with one another along the sides of the forming mold 28 between a forward end wall 28-3 and a rearward end wall 28-4. The forward end wall 28-3 is most preferably conformably shaped to the rearward end wall 28-4, but is dimensionally smaller to an extent that the perimetrical edges joining the transition surface 28-2 which define the forward end wall 28-3 are capable of being coaxially circumscribed by the circular skirt preform 14-1. The transition surface 28-2 is thus sloped or tapered gradually between the forward end wall 28-3 and the forming surface 28-2.

The circular skirt preform 14-1 may thus be initially positioned in coaxially circumscribed relationship with the end wall 28-3 and then forcibly moved onto the mold 28 (arrows $A_2$) via suitable forming rams (not shown) so as to result in the circular geometry of the skirt preform 14 being reformed into a non-circular geometry corresponding to the forming surface 28-1 of the mold 28 as depicted in step 30. As noted previously, the skirt 14, and hence the forming surface 28-1, may be of any desired non-circular shape other than the generally rectangular shape depicted in the accompanying drawing FIGS. 1 and 2A–2B. Thus, for example, the forming surface may be square, oval or elliptically shaped.

In subsequent steps 32 and 34, the skirt 14 and conformably shaped closure disc 12 are mated with one another using conventional edge curl forming dies well known to those in the paperboard forming art. In such a manner, therefore, a non-circular lid 10 having a spirally wound skirt 14 and a conformably shaped closure disc 12 may be made.

The paperboard forming the skirt preform 14-1 most preferably has a moisture content of between about 3 wt. % and about 10 wt. %, and most preferably between about 5 wt. % and about 7 wt. %. With moisture contents within these ranges, the skirt preform 14-1 is sufficiently pliable to allow its circular geometry to be reformed into a non-circular geometry as described above. If the moisture content of the paperboard skirt preform 14-1 is less than the ranges stated above, it can be humidified as needed using standard humidification equipment. Once mated with the closure disc 12, the resulting skirt 14 will retain its non-circular geometry upon drying to residual moisture contents below those stated above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making a non-circular paperboard container lid comprising the steps of:

(a) providing a spirally wound cylindrical paperboard tube;

(b) latitudinally severing the tube to form a plurality of discrete circular preforms;

(c) forcing a circular preform over a non-circular forming surface of a forming mold having a forward end wall which is conformably shaped to, but dimensionally smaller than the non-circular forming surface, and a transition surface joining said forward end wall and said forming surface, to thereby form a non-circular skirt therefrom; and (d) joining the non-circular skirt to a conformably shaped non-circular planar closure disk to thereby form said container lid.

2. The method of claim 1, wherein step (a) includes spirally wrapping a paperboard strip around a cylindrical forming mandrel.

3. The method of claim 2, including wrapping a plurality of paperboard strips around a cylindrical forming mandrel, and adhering said paperboard strips to one another.

4. The method of claim 1, wherein step (c) includes positioning the circular preform in circumscribing relationship to the forward end wall, and then forcibly moving said preform over said transition surface and onto said forming surface.

5. The method of claim 1, wherein said forming surface is generally rectangularly, square, oval or elliptically shaped.

6. The method of claim 1, wherein the paperboard preform has a moisture content of between about 3 wt. % to about 10 wt. %.

7. The method of claim 1, wherein the paperboard preform has a moisture content of between about 5 wt. % to about 7 wt. %.

8. The method of claim 1, wherein step (d) includes mechanically locking perimetrical edges of said closure disc and said skirt to one another.

9. The method of claim 8 wherein said edges are mechanically joined by edge-curling.

* * * * *